United States Patent [19]

Schlicht et al.

[11] 4,446,038

[45] May 1, 1984

[54] CITRIC IMIDE ACID COMPOSITIONS AND LUBRICANTS CONTAINING THE SAME

[75] Inventors: Raymond C. Schlicht, Fishkill; Anthony P. Skrobul, Beacon, both of N.Y.

[73] Assignee: Texaco, Inc., White Plains, N.Y.

[21] Appl. No.: 423,938

[22] Filed: Sep. 27, 1982

[51] Int. Cl.[3] ..... C10M 1/32

[52] U.S. Cl. ..... 252/51.5 A; 548/544

[58] Field of Search ..... 252/51.5 A; 548/544, 548/545, 546

[56] References Cited

U.S. PATENT DOCUMENTS 2,695,905 11/1954 Eilar ..... 548/544

3,219,666 11/1965 Norman et al. ..... 548/545 X

FOREIGN PATENT DOCUMENTS 164334 7/1953 Australia ..... 252/51.5 A 845628 8/1960 United Kingdom ..... 252/51.5 A

*Primary Examiner*—Andrew Metz

*Attorney, Agent, or Firm*—Robert A. Kulason; James J. O'Loughlin; Alan M. Kamel

[57] ABSTRACT

Citric imide acids represented by the formula:

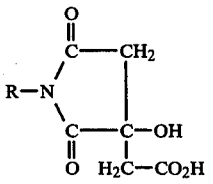

are disclosed, wherein R is a hydrocarbon-based radical having up to 30 carbon atoms. The disclosed citric imide acids are useful as additives in lubricants, especially as friction reducing agents in motor oils and other lubricants.

12 Claims, No Drawings

CITRIC IMIDE ACID COMPOSITIONS AND LUBRICANTS CONTAINING THE SAME

BACKGROUND OF THE INVENTION

The present invention is directed to a new composition of matter, and to oleaginous lubricating oils containing the new compositions. More specifically, the present invention is directed to a novel class of citric imide acids produced by the reaction of citric acid and certain primary amines.

DESCRIPTION OF THE PRIOR ART

Much effort has been expended in preparing and developing additives formed by the reaction of a polycarboxylic acid, such as maleic and succinic acid, and a fatty amine for use as corrosion and rust inhibitors in lubricants and fuels. U.S. Pat. No. 3,183,069, for example, discloses employing for such purposes an N-substituted amic acid (monoamide) that were derived from the reaction product of a fatty amine and a dicarboxylic acid. U.S. Pat. No. 2,977,309, discloses a rust inhibitor additive for use in lubricating oils formed by the reaction product of a branched chain primary amine such as tertiary alkyl amine and an $\alpha,\beta$-dicarboxylic acid.

Amine salts of hydroxy aliphatic polycarboxylic acids have been prepared by the simple mixing of a amine with an acid in the presence or absence of a solvent. Usually the amine is added in excess as disclosed in U.S. Pat. No. 2,811,429.

U.S. Pat. No. 4,237,022 discloses tartarimides having the following structure:

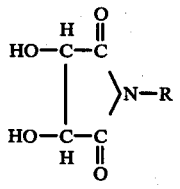

wherein R is a hydrocarbon-based radical of about 5 to 150 carbons or R'OR" in which R' is a divalent alkylene radical of 2 to 6 carbon atoms, and R" is a hydrocarbyl radical of about 5 to about 150 atoms, or R. The patent discloses that these compounds have improved properties in terms of rust inhibition, fuel economy, and dispersancy. Further disclosed is the use of these tartarimide compositions as additives for lubricating oils in which they function as rust and corrosion inhibitors, friction modifiers, and demulsifiers.

Insomuch as the prior art discloses additives comprising amine salts, amides, amic acids, or even amine salts of hydroxy aliphatic polycarboxylic acids, or as in U.S. Pat. No. 4,237,022, a dihydroxy, dicarboxy imide (tartarimide) composition, none disclose the novel compound of the subject invention: a citric imide acid composition which comprises a dicarboxy imide group, a free hydroxy group, and, in addition, a free carboxylic acid that is connected by a methylene group to the same carbon to which the hydroxyl group is attached. The instant compound of the subject invention has unexpectedly and surprisingly been found to be an exceedingly satisfactory friction-reducing additive. These citric imide acid compositions may also serve as effective rust or corrosion inhibitors, or as antiwear additives in lubricating compositions.

SUMMARY OF THE INVENTION

In one major aspect of the invention a new class of citric imide acids is provided, said class being represented by the formula:

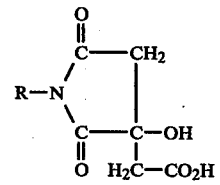

wherein R is a hydrocarbon-based radical of about 5 to 30 carbon atoms, or R'NHR" in which R' is a divalent alkylene having from 2 to 10 carbon atoms and R" is a hydrocarbyl radical having from 5 to 30 carbons.

DETAILED DESCRIPTION OF THE INVENTION

The citric imide acid compositions of the present invention are prepared by reacting citric acid and one or more primary amines having the formula $RNH_2$ wherein R represents a hydrocarbon-based radical of about 5 to 30 carbon atoms, or $R''NHR'NH_2$, an N-alkyl-alkylene diamine in which R' is a divalent alkylene radical having from 2 to 10 carbon atoms and R" is a hydrocarbyl radical having from 5 to 30 carbon atoms.

The hydrocarbon-based radicals of the present invention denote a radical having a carbon atom directly attached to the remainder of the molecule and having a predominantly hydrocarbon character as defined within the context of this invention. Such radicals include: (1) hydrocarbyl radicals, that is, aliphatic (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, any two indicated substituents may together form an alicyclic radical).

The hydrocarbyl radical is preferably aliphatic and comprised of, for example, alkyl or alkenyl groups of 5 or more carbon atoms. Examples of such groups include such monovalent alkyl radicals such as pentyl, hexyl (caproyl), capryl, lauryl, dodecyl, myristyl, pentadecyl, cetyl, margaryl, stearyl, carnaubyl, and behenyl; and alkenyl radicals such as dodecenyl, myristoleyl, palmitoleyl, oleyl and linoleyl.

Primary amines suitably preferred for the present invention are those represented by the formula:

$$RNH_2$$

wherein R represents a long hydrocarbyl radical of 5 to about 30 carbon atoms, usually an alkyl radical of about 5 to about 30 carbons, and preferably from 10 to 20 carbons. Representative amines are those known as aliphatic fatty primary amines and commercially known as Armeen primary amines (products produced by Armak Chemical Company, Chicago, Ill.). Typical amines include alkyl amines such as n-hexylamine (caproylamine), n-octylamine (caprylylamine), n-decylamine (caprylamine), n-dodecylamine (laurylamine), n-tetradecylamine (myristylamine), n-pentadecylamine, n-hexadecylamine (cetylamine), margarylamine, n-octadecylamine (stearylamine). These primary amines are available in both distilled and technical grades. Both grades of amines can be employed to produce the desired citric imide acids, but when amines of a distilled grade are employed a pure reaction product is produced.

Equally as preferred are primary amines in which the hydrocarbon chain comprises olefinic unsaturation. Thus, the R hydrocarbyl group radical may comprise one or more olefinic bonds. The hydrocarbyl radical can contain up to 30 carbon atoms, and preferably from 10 to 20. Representative amines are dodecenylamine, myristoleylamine, palmitoleylamine, oleylamine, and linoleylamine.

In instances where the R group in the primary amine formula disclosed above ($RNH_2$) is either an alkyl or alkenyl radical, various non-reactive or substantially non-hydrocarbon substituents can be attached to the chain, so long as the predominately hydrocarbon character of the radical is not altered. Each of these substituents (that is, non-reactive or substantially non-hydrocarbon substituents) can be attached to any carbon in the chain including the terminal carbon and also may be inserted between segments of the carbon chain. Representative substituents which do not substantially change the hydrocarbon character of the radical when added in the proper amounts and positions and which are within the scope of the invention include arylene, aliphatic carbocyclic, heterocyclic, amino, amide, ester, keto, ether, thioether, sulfoxide and sulfone groups. There are, in addition, other contemplated substituents for the primary amine groups comprised of halogen, halogenoalkyl, and nitrile groups; these may not be placed so as to segment the carbon chain but may only be attached directly to the various carbon atoms (including the terminal carbon atom) comprising the chain.

Also useful in the preparation of citric imide acids of the present invention are N-alkyl-alkylene diamines having the formula $R''NHR'NH_2$ wherein R' is a divalent alkylene radical having 2 to 10 carbon atoms and R'' is a hydrocarbyl radical having from 5 to 30 carbon atoms. These N-alkyl-alkylene diamines are sold under the trademark Duomeen by Armak Chemical Company, Chicago, Ill.

The citric imide acids of the present invention are prepared by adding the fatty amine and the citric acid to the reaction vessel (the order of sequence is not of importance) in the presence of or absence of a solvent or diluent oil. The reactants are then heated to about 100° C. or more (preferably under an inert atmosphere) to remove the water of reaction. After, the formed product or the formed product solution (if a solvent or diluent oil is used) is filtered and the desired product recovered. In instances where a solvent is used, the product may be distilled either at atmospheric or at sub-atmospheric pressure to remove the solvent. Solvents which remain liquid at relatively high reaction temperatures are preferred. As such, toluene, xylene, ethylbenzene, heptanes, octanes, decanes and mineral oils are preferably employed.

The citric imide acids of the present invention can be solids, semi-solids, or oils depending on the particular primary amine used in preparing the citric imide acid. For use as additives in oleaginous lubricating compositions, the citric imide acids will have to be soluble and/or stably dispersible, or both, in such compositions. By the term oil-soluble is meant that the subject compositions are soluble to an extent which permits the formed solution to exhibit one or more of the desired properties; by the term stably dispersible, the compositions are capable of being suspended in the oleaginous lubricating composition in an amount sufficient to allow the oil to possess one or more of the desired properties imparted to it by the suspended composition. The suspension of the composition can be achieved in various conventional ways, such as by physical agitation, and by the use of conventional dispersants.

The citric imide acids of the invention can be combined with diluents to form a variety of concentrates, with said diluents being substantially inert. When the solvent, diluent, or the like is added to the compounds of the subject invention, the properties of the same are not materially interfered with in an adverse manner in such areas as compound preparation, storage, blending and/or functioning in the context of its intended use.

The compositions of the subject invention can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines; two cylinder engines; aviation piston engines; marine and railroad diesel engines; and the like. They can also be used in gas engines, stationary power engines and turbines and the like. Automatic transmission fluids, trans-axle lubricants, gear lubricants, metal-working lubricants, hydraulic fluids and other lubricating oil and grease compositions can also benefit from the incorporation therein of the compositions of the present invention.

Without being bound to one theory of how these citric imide acid compositions function as friction modifiers in lubricating oil compositions, it has been theoretically proposed that the outstanding performance of the compound is the result of a strong bond formed between the subject compound and the metal ions on the metal surface contacting with the lubricating oil composition. The subject composition, unlike those heretofore known in the prior art, has extending off one carbon in the heterocylic chain two polar groups: a hydroxyl and methylene-attached carboxyl group. In forming the bonds the polar groups of the subject composition are bonded to the metal ions on the surface; the formation of the chelate occurs readily because the polar groups are in close proximity to each other. Also facilitating in this chelate formation is the oxygen bonding that occurs between the polar groups and metal ions; for example, FeIII demonstrates very great affinity for compositions which bond via oxygen.

Thus, after chelation occurs, the polar part of the composition is absorbed onto the metal surface to form a strongly bonded layer; the fatty alkyl group attached to the polar portion of the composition extends out from the surface. When the metal parts are in motion, the fatty alkyl groups reduce the degree of contact between the asperities of the parts; therefore, friction is correspondingly reduced. The metal parts are worn out less rapidly than if the citric imide acid was not present in a contacting oleaginous lubricating oil composition. Equally as important, a fuel savings is realized: less fuel is required in any given circumstance as the amount of energy expended in overcoming frictional resistance is lessened.

These citric imide acid compositions are added in sufficient amounts to bring about the desired effect: reduced friction. As the examples detailed below will demonstrate, amounts as little as 0.5 weight percent have produced in the Small Engine Friction Test a 10 percent reduction in friction. It is possible to add amounts less than 0.5 weight percent, provided an effective reduction in friction is realized. It is preferred, however, that amounts of from 0.2 to 1.0 weight percent of additive be added to a oleaginous lubricating composition. The oleaginous lubricating oil composition can, in addition, comprise various other conventional additives, such as dispersants. Included within this list, but not limited thereto, are conventional additives such as alkenylsuccinimide, overbased calcium sulfonate, polyethoxylated alkylphenol, zinc dialkyldithiophosphate, diarylamine, polymethacrylate, an olefin copolymer, or a silicon antifoamant.

The following examples are provided to further illustrate the invention:

EXAMPLE I

To 137.0 grams (0.5 mole) of Armeen O (a commercial oleyl amine from the Armak Chemical Company) dissolved in 300 ml. of xylene, 96.0 grams (0.50 mole) of anhydrous citric acid was stirred in. The mixture was heated under an $N_2$ atmosphere to reflux, and the water of reaction was collected for 2 hours at a maximum temperature of about 137° C. in a Dean-Stark trap until the calculated water of reaction (18.0 ml.) was collected. The mixture was then cooled and filtered, and the filtrate was then stripped under 10 mm. Hg at 120° C. to remove the xylene. The product weighed 211 grams and appeared light yellow in color. An infrared spectrum reading at 1790 and 1714 cm.$^{-1}$ demonstrated the presence of imide carbonyl groups; a shoulder on the low-frequency side of the 1714 cm.$^{-1}$ was attributed to a carboxylic acid carbonyl group, and a broad band reading at 3600–3800 cm.$^{-1}$ was attributed to presence of the hydroxyl group.

EXAMPLE II

The procedure of Example I was repeated except that the removal of water was completed over 11 hours and conducted at a maximum temperature of 181° C. The reaction yielded 202 grams of product.

EXAMPLE III

The procedure of Example 1 was repeated except that 47.5 grams (0.18 moles) of Armeen OL (an oleyl amine from the Armak Chemical Company) and 34.6 grams (0.18 moles) of citric acid are added, respectively.

EXAMPLE IV

The procedure of Example II was repeated except that 92.50 (0.5 moles) of N-dodecylamine and 96 grams (0.50 mole) of citric acid are added, respectively.

EXAMPLE V

The procedure of Example II was repeated except that 200 grams (0.5 moles based on a diamine content of 89% of Duomeen O (an N-oleyl-1,3-propanediamine from the Armak Chemical Company) and 96 grams (0.5 moles) of citric acid are added, respectively.

EXAMPLE VI

To 32.7 grams (0.17 mole) of anhydrous citric acid was added 110 ml. of xylene and the mixture was heated to 100° C. To this mixture was added 44.9 grams (0.17 mole) of Armeen OL over a 1 hour period. After all the Armeen OL had been added, the resulting solution was heated for over 2 hours at reflux (a temperature of 141° C., max.) under a $N_2$ atmosphere. After stripping and filtering, 68 grams of the product (95% of the theoretical amount calculated) was obtained.

EXAMPLE VII

To 192.1 gram (1.0 mole) of anhydrous citric acid was added 800 mls. of xylene; then 264 grams (1.0 mole) of Armeen OL was added over a period of 20 minutes. The resulting mixture was heated under an $N_2$ atmosphere at 139° C., max. for 1.5 hours. After 36 mls. of water had been collected in the Dean-Stark trap, the mixture was filtered and the filtrate was then stripped under vacuum (15 mm $H_g$)at a temperature of 120° C. The reaction yielded 416 grams of product (99% of the theoretical amount calculated).

EXAMPLE VIII

A mixture of 52.8 grams of Armeen OL (0.20 moles) and 38.4 grams of citric acid (0.20 moles) was heated under an $N_2$ atmosphere at 150° C. for 5 hours and filtered hot through a dry filter-aid. The reaction yielded 60 grams of product (71.4% of the theoretical amount calculated).

Table I following details the results of the already described Examples I–VIII.

TABLE I

PREPARATION OF N—ALKYLIMIDES OF CITRIC ACID

| Example No. | AMINE | Amine Charged Wt., g | Amine Charged Moles | Moles of Citric Acid | Yield, g. | ANALYSES % N Found | % N Calc. | Total Acid Number Found | Total Acid Number Calc. |
|---|---|---|---|---|---|---|---|---|---|
| I | Armeen O (cml. Oleyl Amine) | 137.0 | 0.5 | 0.5 | 211 | 3.10 | 3.26 | 153 | 130 |
| II | Same | Same | Same | 202 | 3.47 | 3.26 | 112 | 130 | |
| III | Armeen OL[1] (Oleyl Amine) | 47.5 | 0.18 | 0.18 | 69 | 3.31 | 3.34 | 99.8 | 133.6 |
| IV | n-Dodecylamine | 92.50 | 0.5 | 0.5 | 172 | 4.02 | 4.11 | 190 | 165 |
| V | Duomeen O (N—Oleyl-1, 3-propanediamine) | 200.0 | 0.5[2] | 0.5 | 240 | 5.95 | 5.5 | 121 | 101 |
| VI | Armeen OL[1] (Oleyl Amine) | 44.9 | 0.17 | 0.17 | 68 | 3.54 | 3.34 | 124.3 | 133.6 |
| VII | Same | 264 | 1.0 | 1.0 | 416 | 3.20 | 3.34 | 123.4 | 133.6 |
| VIII | Same | 52.8 | 0.2 | 0.2 | 60 | 3.28 | 3.34 | 142.2 | 133.6 |

[1]A grade of commercial oleyl amine of greater purity than Armeen O.
[2]Based on a diamine content of 89%.

The additives of the subject invention were added in amounts ranging from 0.5 to 1 percent by weight into a commercial SAE-10W-40 motor oil comprising a base oil blend with the following conventional additives:

| Additive | Dose, % Wt. |
|---|---|
| Alkenylsuccinimide dispersant | 0.08 N |
| Overbased calcium sulfonate | .23 Ca |
| Polyethoxylated alkylphenol | .15 |
| Zinc dialkyldithiophosphate | .15 Zn |
| Diarylamine | .25 |
| Oil conc. of a polymethacrylate | .10 |
| Oil conc. of an olefin copolymer | 11.70 |
| Silicone antifoamant | 150 ppm |

Six different lubricating oil formulations were prepared, including a lubricating oil formulation containing no friction modifier, and they were tested in the Small Engine Friction Test.

The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded, compared to a reference band consisting of data from up to three reference runs made before and three runs made after the test oil evaluation.

The results of these results conducted are outlined in Table II below:

TABLE II

FRICTION TESTS WITH OIL BLENDS COMPRISING BASE OIL BLEND AND DIFFERING AMOUNTS AND TYPES OF CITRIC IMIDE ACIDS

| | Friction Modifier[1] | | Small Engine Friction Test |
|---|---|---|---|
| OIL | Example No.[3] | Amount Added (%) | Friction Reduction (%)[2] |
| A | None | None | 0 |
| B | I | 1.0 | 13.9 |
| C | IV | 0.50 | 10.3 |
| D | V | 1.00 | 3 |
| E | III | 0.50 | 13.0 |
| F | VI | 0.50 | 10.4 |

[1]The friction modifiers were blended at the indicated dosages into an SF/CC 10W-40 motor oil which is prepared as detailed above.

[2]With a lubricating composition comprising additives of the instant invention a reduction in friction (torque) is observed in an engine operating at 280° F.; the results obtained represent a % reduction in friction in which the oil samples A–F are compared, in turn, against the median value calculated from six runs of the test with the 10W-40 base motor oil.

[3]The tested citric imide acids are those that were prepared in the indicated prior detailed examples.

It has been surprisingly and unexpectedly found that lubricating oil compositions containing the citric imide acid compositions of the invention are effective in reducing engine friction; this is demonstrated by the results in Table II where these citric imide acid containing lubricating oil compositions are employed as crankcase lubricants. Previous to this invention, the instant citric imide acid compositions were unknown; and as it therefore follows, their use as friction reducing additives in an oleaginous lubricating oil composition were also unknown.

We claim:

1. An oleaginous composition comprising a major proportion of a mineral or synthetic oil of lubricating viscosity and a minor friction reducing amount of the citric imide represented by the formula:

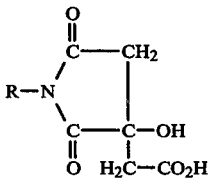

wherein R is a hydrocarbyl radical of about 5 to about 30 carbon atoms, or R'NHR" in which R' is a divalent alkylene radical of 2 to 10 carbon atoms and R" is a hydrocarbyl radical having from 5 to 30 carbon atoms.

2. The citric imide composition of claim 1 wherein R is an aliphatic or an alkenyl radical having from about 10 to about 30 carbon atoms.

3. The citric imide composition of claim 2 wherein R is an alkyl or an alkenyl radical having from about 10 to about 20 carbon atoms.

4. The citric imide composition of claim 3 wherein said alkenyl radical is oleyl.

5. The citric imide composition of claim 3 wherein said alkyl is n-dodecyl.

6. The citric imide composition of claim 1 is R'NHR" and wherein R' is a divalent alkylene radical of 3 carbon atoms and R" is an oleyl group.

7. An oleaginous composition of claim 2 wherein the citric imide acid is incorporated in amounts of from about 0.01 to about 10 percent by weight.

8. An oleaginous composition of claim 2 wherein the citric imide acid is incorporated in amounts of from 0.1 to about 5 percent by weight.

9. An oleaginous composition of claim 2 wherein the citric imide acid is incorporated in amounts of from 0.2 to about 1 percent by weight.

10. A concentrate comprising a mineral or synthetic lubricating oil and from 10 to 90% by weight of the citric imide acid represented by the formula:

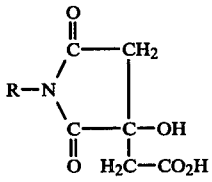

wherein R is a hydrocarbyl radical of about 5 to about 30 carbon atoms, or R'NHR" in R' is a divalent alkylene radical of 2 to 10 carbon atoms and R" is a hydrocarbyl radical having from 5 to 30 carbon atoms.

11. A concentrate comprising a mineral or synthetic lubricating oil and from 10 to 90% by weight of the citric imide acid represented by the formula:

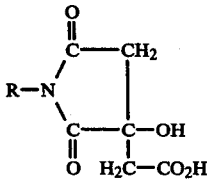

wherein R is a hydrocarbyl radical of about 5 to about 30 carbon atoms, or R'NHR'' in R' is a divalent alkylene radical of 2 to 10 carbon atoms and R'' is a hydrocarbyl radical having from 5 to 30 carbon atoms.

12. A method for operating an internal combustion engine which comprises supplying to the crankcase and lubricating system of said engine, a lubricating oil composition comprising a major portion of a mineral or synthetic oil of lubricating viscosity and a minor friction reducing amount of the citric imide acid represented by the formula:

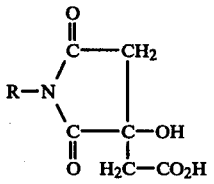

wherein R is a hydrocarbyl radical of about 5 to about 30 carbon atoms, or R'NHR'' in R' is a divalent alkylene radical of 2 to 10 carbon atoms and R'' is a hydrocarbyl radical having from 5 to 30 carbon atoms.

* * * * *